United States Patent [19]

Haneda et al.

[11] Patent Number: 5,047,801

[45] Date of Patent: Sep. 10, 1991

[54] COLOR IMAGE FORMING APPARATUS HAVING THE DEVELOPING MEANS AND CLEANING MEANS FORMED AS A DETACHABLE UNIT

[75] Inventors: Satoshi Haneda; Masakazu Fukuchi; Hisashi Shoji; Shunji Matsuo; Shizuo Morita, all of Hachioji, Japan

[73] Assignee: Konica Corporation, Tokyo, Japan

[21] Appl. No.: 444,570

[22] Filed: Dec. 1, 1989

[30] Foreign Application Priority Data

Dec. 6, 1988 [JP] Japan ..... 63-308148
Dec. 12, 1988 [JP] Japan ..... 63-314360

[51] Int. Cl.[5] ..... G03G 15/00; G03G 15/01

[52] U.S. Cl. ..... 355/200; 355/210; 355/327

[58] Field of Search ..... 355/200, 210, 308, 326, 355/327

[56] References Cited

U.S. PATENT DOCUMENTS

| | | | |
|---|---|---|---|
| 4,605,299 | 8/1986 | Mochimaru | 355/200 |
| 4,642,661 | 2/1987 | Dean, II | 346/153.1 |
| 4,664,504 | 5/1987 | Oda et al. | 355/297 |
| 4,682,880 | 7/1987 | Fujii et al. | 355/327 |
| 4,733,274 | 3/1988 | Tachika et al. | 355/200 |
| 4,814,817 | 3/1989 | Nishijima et al. | 355/200 |

FOREIGN PATENT DOCUMENTS

| | | | |
|---|---|---|---|
| 72159 | 4/1983 | Japan . | |
| 279870 | 12/1986 | Japan . | |
| 0031865 | 2/1987 | Japan . | |
| 0246760 | 10/1988 | Japan | 355/327 |

*Primary Examiner*—A. T. Grimley
*Assistant Examiner*—Nestor R. Ramirez
*Attorney, Agent, or Firm*—Jordan B. Bierman

[57] ABSTRACT

An electrostatic image forming apparatus for forming a color image wherein plural developers are located substantially under the image retainer, at least two of the image retainer, the developer, and the cleaner being formed as a detachable unit.

7 Claims, 9 Drawing Sheets

COLOR IMAGE FORMING APPARATUS HAVING THE DEVELOPING MEANS AND CLEANING MEANS FORMED AS A DETACHABLE UNIT

BACKGROUND OF THE INVENTION

This inventions relates to a color image forming apparatus by the photoelectric method, which is miniaturized for improving the maintainability and modified for improving the jamming repairability.

A photoelectric image forming apparatus which forms full color images or monochromatic images comprises a charger for charging a photosensitive drum, image exposure means for exposing an image on the photosensitive drum, a developing unit for developing an electrostatic image on the photosensitive drum with toners, and a transfer device for transferring a toner image from the photosensitive drum to a recording paper which are arranged around the photosensitive drum.

A photoelectric image forming apparatus for full color images comprises three or four developing units, each of which contains a black (BK) toner when yellow (Y), magenta (M), and cyan (C) toners are to be used, and while the photosensitive drum is rotating three times, a black (BK) toner image is formed on the photosensitive drum as well as yellow (Y), magenta (M), and cyan (C) toner images. By transferring the toner images on a recording paper, a full color image is obtained. When such an image forming method is to be used, the color image forming apparatus can be miniaturized by making developing units thinner and arranging three or four of them close to each other.

A color image forming apparatus using such an image forming method is indicated in Japanese Patent Application Laid-Open 55661/1986. The apparatus forms latent images using three laser beams corresponding to the three developing units; and the photosensitive drum, developing units, and cleaning means are integrated to a unit which can be removed from the main unit of the apparatus.

The color image forming apparatus indicated in Japanese Patent Application Laid-Open 55661/1986 is useful for improving the maintainability but has a disadvantage that developers are apt to be dropped or mixed during installation or removal of the unit.

An example of a unitized photosensitive drum and others of a color image forming apparatus for transferring each color toner image on a recording paper using a transfer drum is indicated in Japanese Patent Application Laid-Open 72159/1983, 43170/1988 and 43171/1988.

In the color image forming apparatus indicated in Japanese Patent Application Laid-Open 72159/1983, 43170/1988 and 43171/1988, however:

(1) The image forming section includes not only the photosensitive drum and surroundings but also the transfer drum.

(2) Between the photosensitive drum and the transfer drum, the peripheral speed and the gap must be retained highly accurately.

(3) To remove the photosensitive drum from the main unit, a release mechanism is required.

In a color image forming apparatus using a transfer drum, as mentioned above, the mechanism of the apparatus is complicated and expensive as described in above (2) and (3), and the image forming means are not centralized around the photosensitive drum compared with a monochromatic image forming apparatus requiring no transfer drum, and the image forming section is not provided with a satisfactory advantage of unitization (process unit).

An object of the present invention is to provide a color image forming apparatus which has a cartridge structure that the developing unit, image retainer such as a photosensitive drum, and cleaning means can be inserted or removed as one, or two of them as one and the remaining one independently so as to improve the maintainability, comprises a plurality of developing units which are unitized so as to prevent developers from being dropped outside or introduced into another developing units when some unit, especially the developing unit is to be inserted into or removed from the main unit of the apparatus, and allows easy jamming repair when an error occurs in a recording paper while feeding.

Another object of the present invention is to provide a color image forming apparatus using a process that composite color toner images using a plurality of color toners are formed on the surface of the photosensitive drum and transferred onto a recording paper in a batch, which is structured so that the image forming means such as a plurality of developing units and the cleaning means are centralized around the photosensitive drum to make the apparatus small and compact; and the plural developing units in a flat form are arranged on one side of the peripheral surface of the photosensitive drum. The open direction of the upper frame of the main unit is set so as to provide outstanding operability since the developing unit comprising the plural developing units is heavy.

SUMMARY OF THE INVENTION

The above objects are accomplished by a color image forming apparatus comprising a charger, a plurality of developing units, and a cleaning unit installed around an image retainer, which is characterized in that the plural developing units are arranged under or aside the image forming unit; and the plural developing units, image retainer, and cleaning unit or any two of them are unitized, and the unitized section is able to be replaced.

DETAILED DESCRIPTION OF THE INVENTION

Figure 1A:
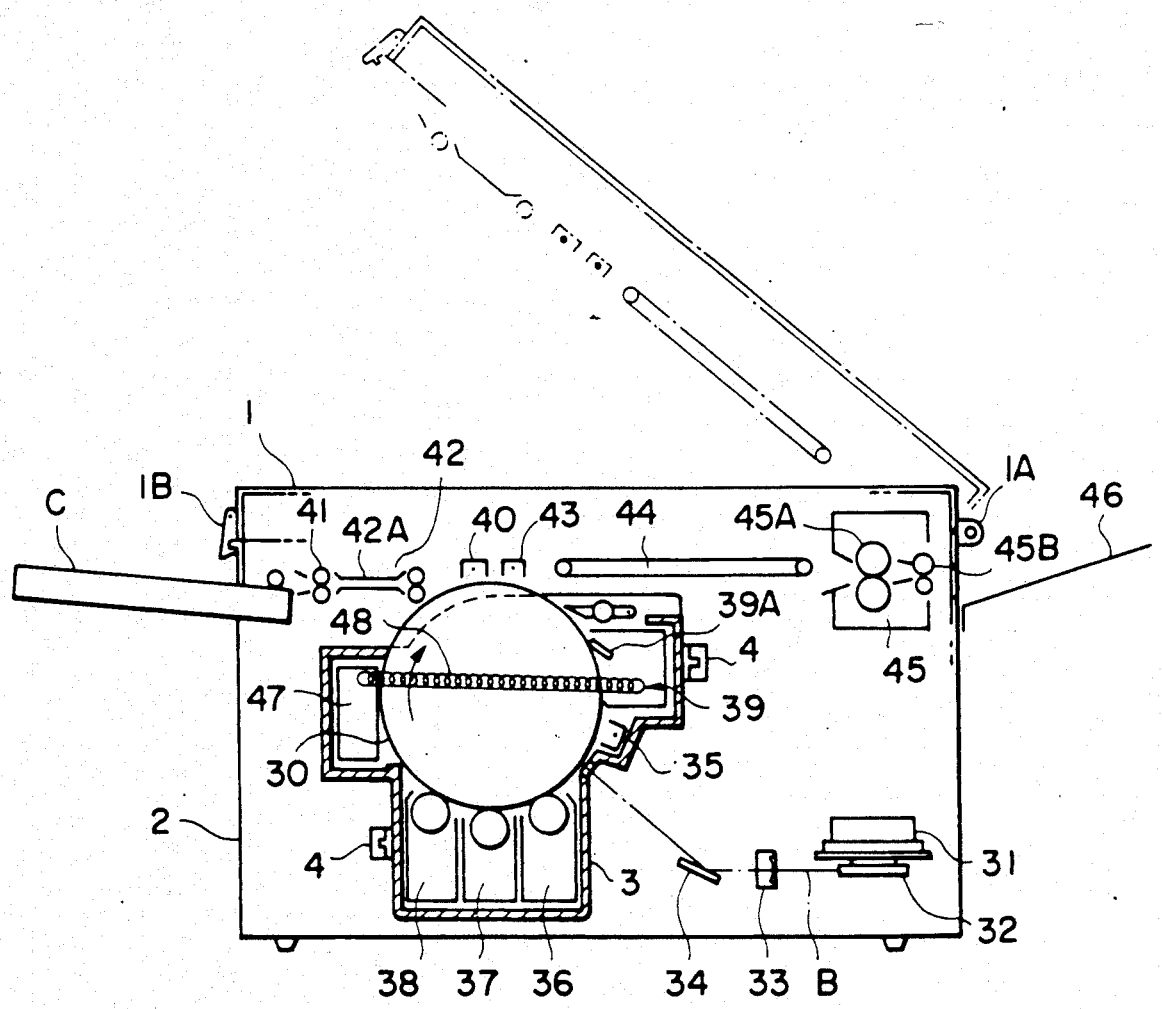
FIGS. 1(*a*), 1(*b*), 2, 3(*a*) and 3(*b*) show sectional views of color image forming apparatuses of the present invention, FIGS. 4(*a*), 4(*b*) and 4(*c*) show sectional views of a developing unit to be used for the apparatuses, and FIGS. 5(*a*), 5(*b*), 5(*c*) and 5(*d*) show configuration examples of process cartridges to be used for the apparatuses.
Figure 1B:
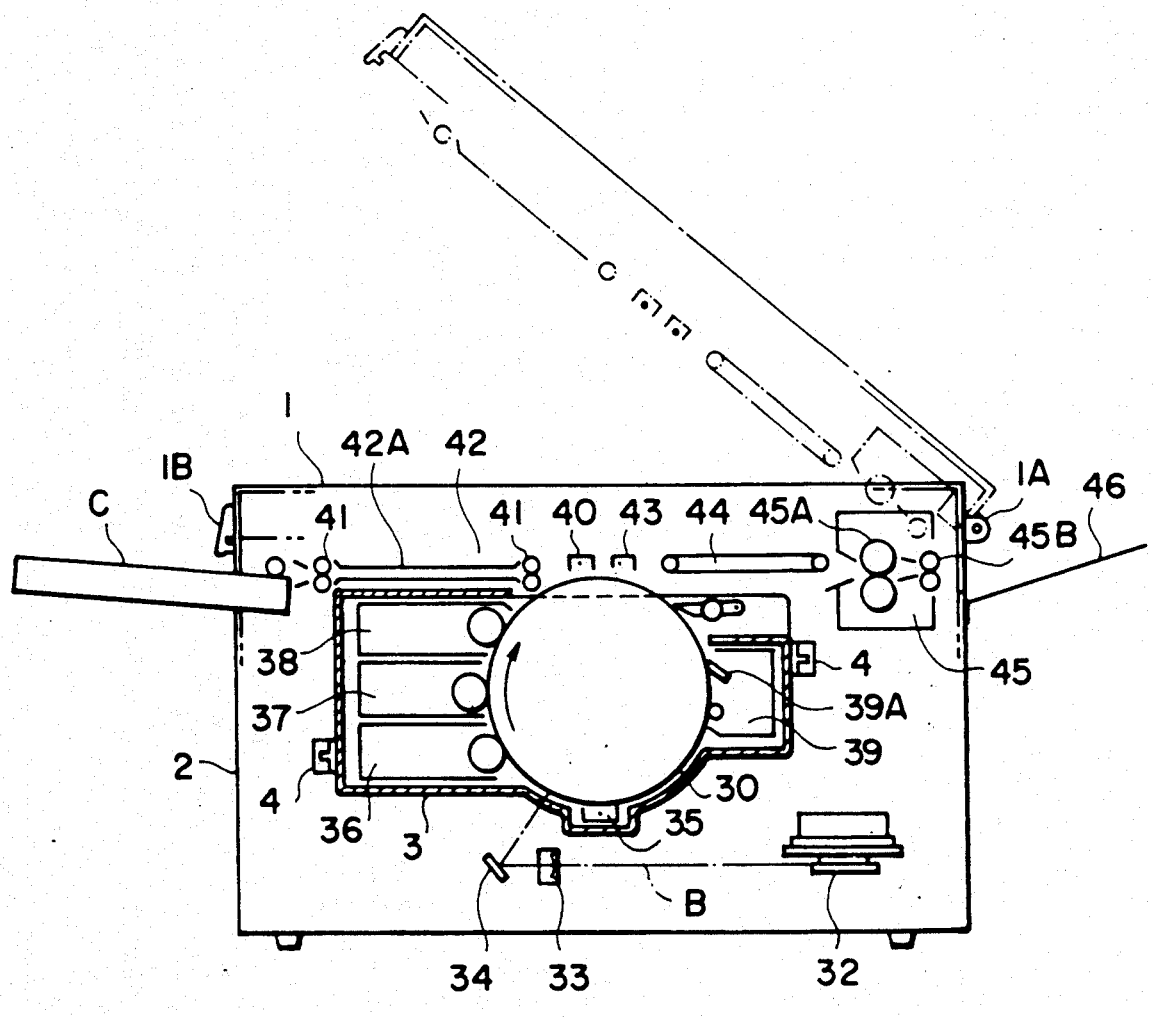

FIG. 1(*a*) shows the first embodiment using a printer which the present invention is applied to.

The printer has a clamshell structure that it is divided into two parts, an upper frame 1 and a main unit 2 of the apparatus. The upper frame 1 can be retained at a predetermined angle by a hinge 1A attached to the main unit 2, and it can also be unitized with the main unit 2 by a fitting 1B when the frame is closed.

An image retainer 30, developing units 36, 37, and 38 containing yellow, magenta, and cyan developers respectively, a cleaning unit 39, and a charger 35 are installed in a solid process cartridge 3, and the cartridge can be inserted into or removed from the main unit 2 via a pair of guide members 4 joined on the right and left outer surfaces of the cartridge. In the present invention, the developing units 36, 37, and 38 are sequentially arranged vertically starting at the upstream point of rotation under the image retainer 30 so that the developing units face toward the peripheral surface of the image forming unit.

The process cartridge 3 can be inserted and set in the depth direction of the main unit 2 using a handle (not shown in the figure) mounted to the front of the cartridge by the joints of the guide members 4; the process cartridge 3 can also be removed from the main unit 2 by pulling out toward the operator and releasing the guide members. Each developing unit is positioned so as to set the opening; therefore, it is to be prevented that the developer leaks from the unit or is introduced into other developing units.

The printer uses a method that a laser writing system unit B is installed in the space aside the process cartridge 3; the feeding surface of a recording paper is over the portion across the upper frame 1 of the process cartridge 3 and the main unit 2; a laser beam is irradiated onto the image retainer 30 by the laser writing system unit B from the obliquely lower point; and color toner images superposed on the peripheral surface of the image forming unit are transferred to the underside of the recording paper.

The color image copying process by the printer is as follows:

When a color signal outputted from an image reader separately installed from the printer is supplied to the laser writing system unit B, a laser beam generated by a semiconductor laser system (not shown in the figure) of the laser writing system unit B is irradiated by using a polygon mirror 32 which is rotated by a drive motor 31, bent in path by a mirror 34 via a f$\theta$ lens 33, and projected on the peripheral surface of the image retainer 30 charged by the charger 35 to form a bright line.

When the scanning starts, the beam is detected by an index sensor and started to be modulated by the 1st color signal, and the modulated beam is scanned on the peripheral surface of the image retainer 30. By doing this, a latent image corresponding to the 1st color is formed on the peripheral surface of the image retainer 30 by the maine scanning of the laser beam and by the sub-scanning by the rotation of the image retainer 30. This latent image is developed by the developing unit 36 containing a yellow (Y) toner (a developing medium) which is a part of the developing means, and a toner image is formed on the surface of the drum. The obtained toner image which is retained on the drum surface passes under the cleaning unit 39 away from the peripheral surface of the image retainer 30 and enters the next copy cycle.

The image retainer 30 is charged once again by the charger 35, and then the 2nd color signal outputted from the signal processing section is supplied to the laser writing system unit B and written on the drum surface in the same way as with the 1st color signal, and a latent image is formed. The latent image is developed by the developing unit 37 containing a magenta (M) toner as a second color.

This magenta (M) toner image is formed under the condition that the formed yellow (Y) toner image mentioned above exists.

The developing unit 38 contains a cyan (C) toner, and forms a cyan (C) toner image on the drum surface on the basis of a control signal generated by the signal processing section. A DC and/or AC bias voltage is applied to the sleeves of the developing units 36, 37, and 38, and jumping development is performed by a two-component developer which is a developing means, and then non-contact development is performed on the image retainer 30 with the base grounded.

The color image formed on the peripheral surface of the image retainer 30 by the above processing is transferred on the underside of the recording paper fed from a paper feed cassette C via paper feed rollers 41 and a paper feed guide 42 by a transfer charge 40.

The recording paper on which the toner image is transferred is separated from the peripheral surface of the drum by a separation charge 43 and conveyed to a fixing machine 45 via a suction type conveyor belt 44. The toner is melted and fixed by fixing rollers 45A, and then the recording paper is discharged by paper discharge rollers 45B to a tray 46.

A dielectric belt having a mechanism for pressing or releasing the image forming unit may be used as transfer and separation means. In this case, the dielectric belt may serve as a suction type conveyor belt 44.

A blade 39A of the cleaning unit 39 touches the image retainer 30 which separates the recording paper from the peripheral surface of the drum and removes a remaining toner. When the toner removal is finished, the cleaning unit is separated from the peripheral surface of the drum, and the apparatus enters a new color image forming process.

The recording paper is conveyed, as mentioned above, horizontally on the upper part of the process cartridge 3 and the underside of the recording paper is a transfer surface, hence even if some toner is dropped or splashed from the cleaning unit 39, the image surface will not be soiled.

The removed toner is collected in a waste toner box 47 conveyed by a screw 48. It is desirable to install the waste toner box in the space on the left of the process cartridge 3 which is structured as shown in FIG. 1(*a*) in view of the balance and space. In the figure, the waste toner box 47 is unitized with the process cartridge 3, though the box may be located on the main unit side, instead.

By installing the upper rollers of the paper feed rollers 41, of fixing rollers 45A, and of paper discharge rollers 45B which constitute the feeding surface of the recording paper, and the upper paper feed guide 42A, conveyor belt 44, transfer charge 40, and separation charge 43 on the upper frame 1 side, the recording paper feeding surface can be wholly opened as shown by an alternate long and short dash line when the cover of the upper frame 1 is removed, allowing for easy jamming repair and maintenance.

The large-scale and heavy process unit 3 with such a configuration is not required to move, so that the upper frame 1 can be made small and light in weight, allowing for easy handling.

Figure 2:
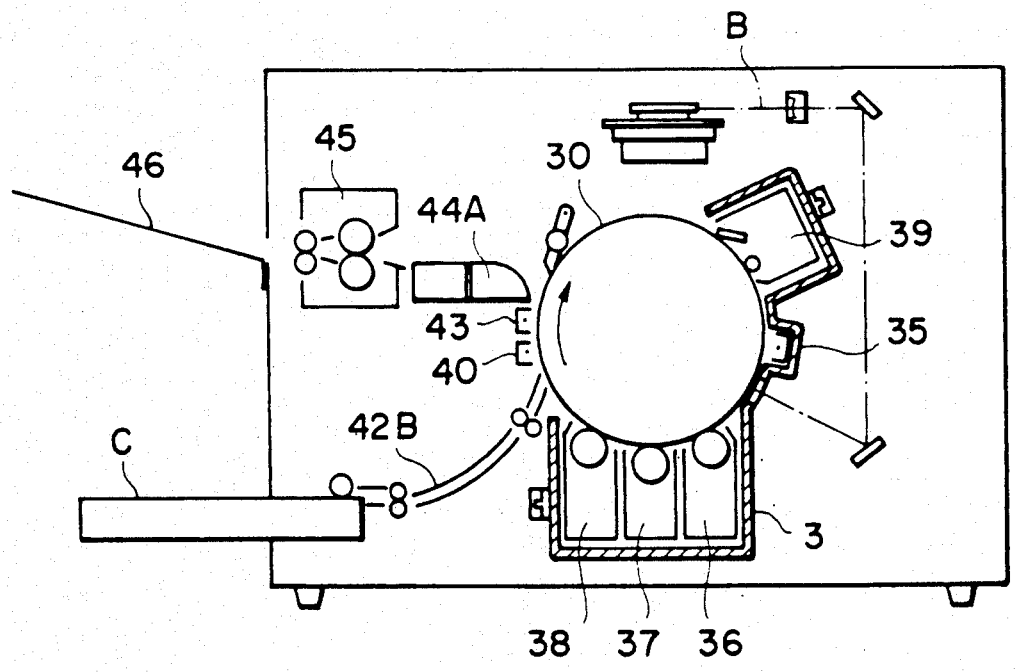

FIG. 2 shows the second embodiment indicating a layout example as well as the printer. The laser writing system unit B is installed above the process cartridge 3 and the recording paper is fed and discharged on one side of the apparatus, so that the apparatus is minimized in width.

Also in this case, a laser beam is irradiated onto the image retainer 30 by the laser writing system unit B from the obliquely lower point via a mirror. The recording paper is fed to the transfer charge 40 via the curved paper feed guide 42B and turned upside down by the suction type conveyor guide 44A after passing through the separation charge 43, and then fed to the fixing machine 45.

Figure 3A:
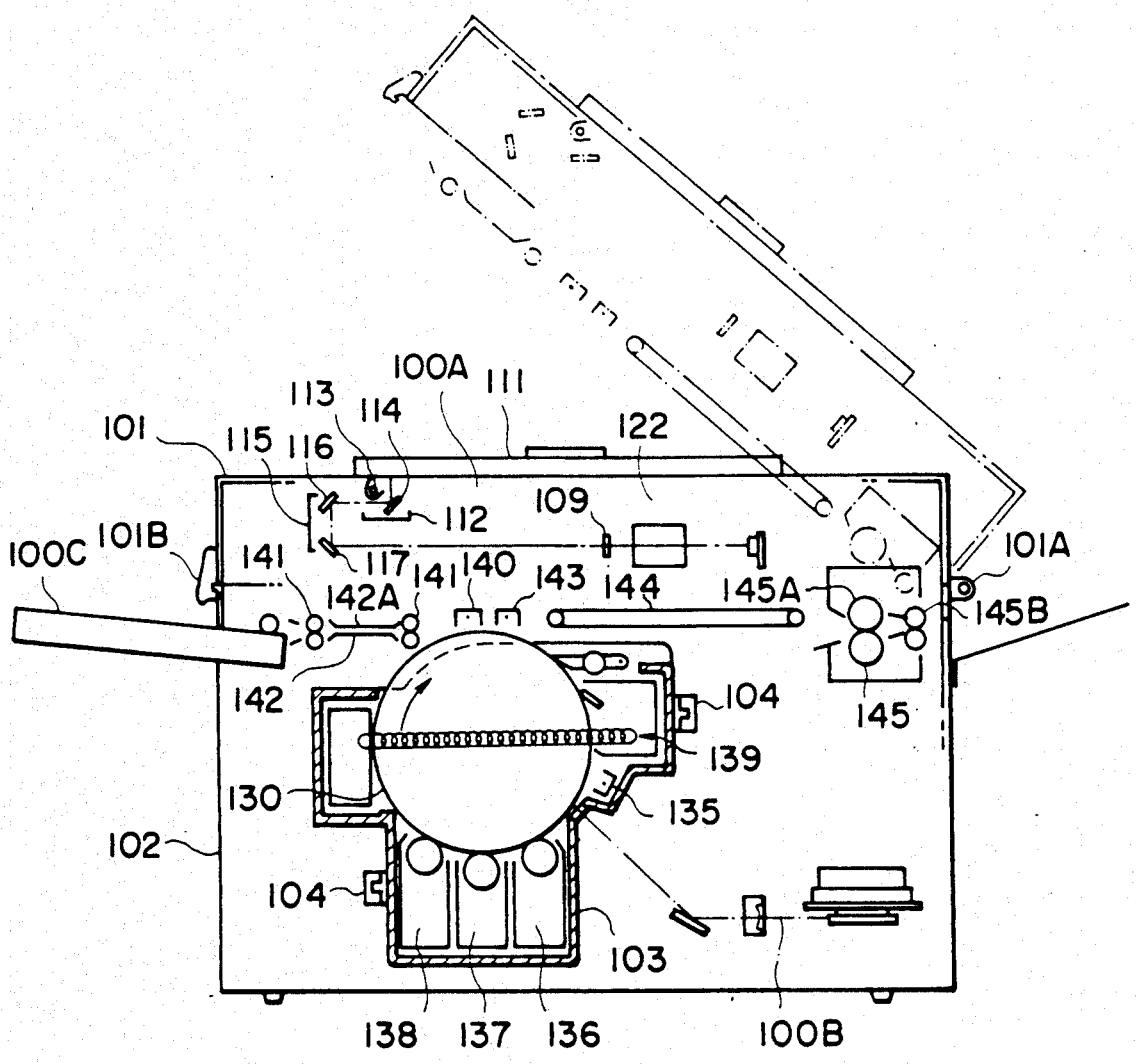
Figure 3B:
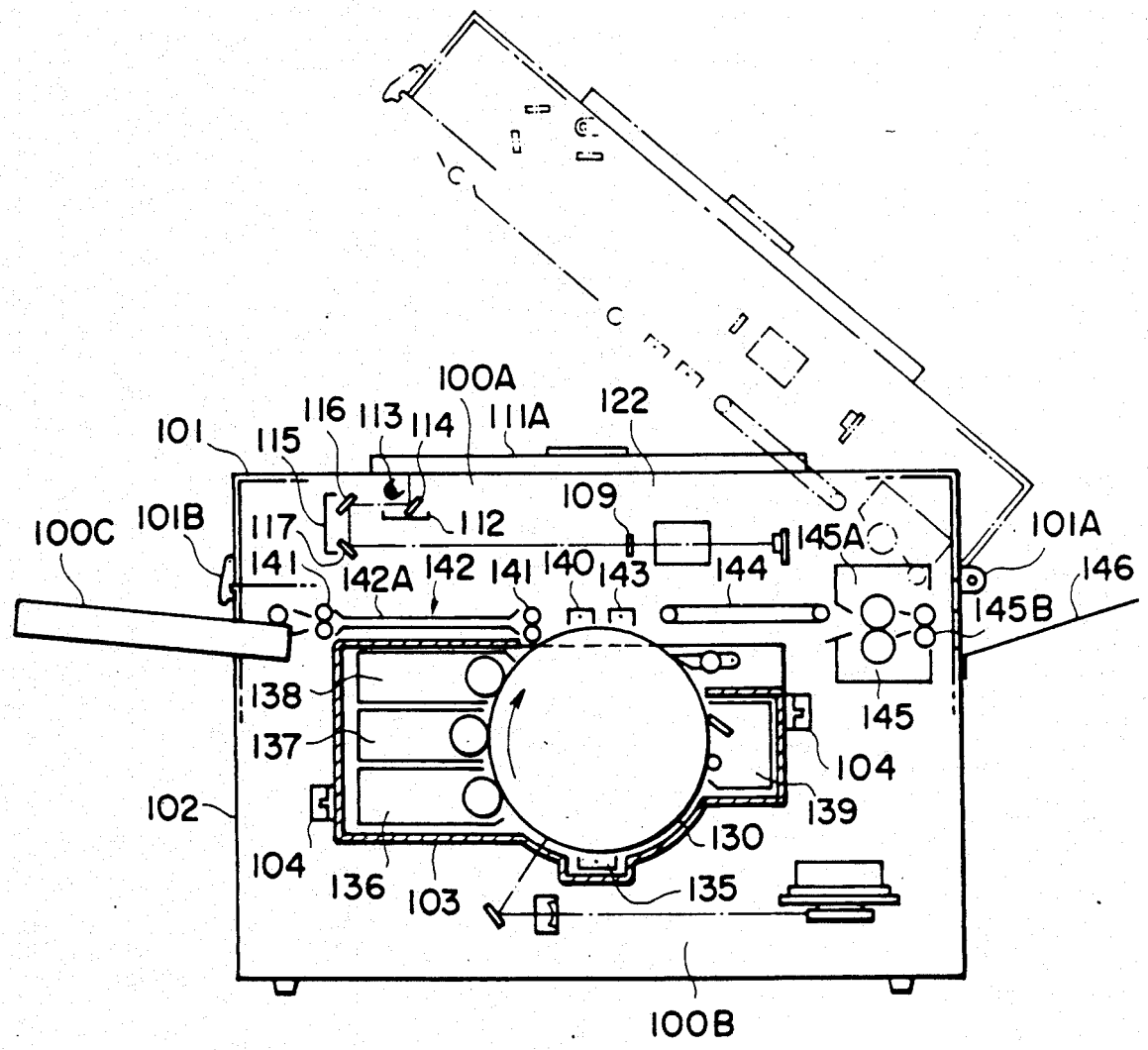

FIG. 3(*a*) shows the third embodiment using a copy machine which the present invention is applied to.

This embodiment, in the same way as with the first embodiment, has a clamshell structure that the apparatus is divided into two parts, an upper frame 101 and a main unit 102 of the apparatus. The upper frame 101 is supported with a hinge 101A so that it can be opened or closed and fixed by a fitting 101B.

An image forming unit 130 constituting an image forming section of the copier, developing units 136, 137, and 138 containing yellow, magenta, and cyan developers respectively, a cleaning unit 139, and a charger 135 are installed in a process cartridge 103 which is the same type as that of the first embodiment, and the cartridge can be inserted into or removed from the main unit 102 via a pair of guide members 104 joined on the right and left outer surfaces of the cartridge according to the procedure for the process cartridge 3.

The copy machine uses a method that a laser writing system unit 100B is installed in the space aside the process cartridge 103; an image reading system unit 100A is installed in the upper frame 101, the feeding surface of a recording paper is over the portion across the upper frame 101 and the main unit 102; a laser beam is irradiated onto the image forming unit 130 by the laser writing system unit 100B from the obliquely lower point; and the color toner images formed on the image forming unit 130 are transferred to the underside of the recording paper.

The color image copy process of the copy machine is as follows:

Numeral 111 of the reading system unit 100A indicates a document table. A document placed on the document table 111 is illuminated by a halogen lamp 113 mounted to a carriage 112 which slides horizontally. A movable mirror unit 115 comprises mirrors 116 and 117. The movable mirror unit 115 also slides horizontally, and an optical image of the document is supplied to an image reading section 122 using a combination of the mirrors 116 and 117 and a mirror 114 mounted to the carriage 112.

The carriage 112 and the movable mirror unit 115 are driven via cables (not shown in the figure) connected to a stepping motor(not shown in the figure), and slide in the same direction at speeds of V and ½ V respectively.

When a document placed on the document table 111 such as a platen glass is to be read by the image reading section 122, colors are resolved via a filter 109. The filter 109 comprises, for example, a filter R, a filter G, a filter B, and a filter ND. The document is read through one of the filters R, G, B, and ND. One of the filters R, G, B, and ND can be selected by moving the filter 109 perpendicularly to the paper of FIG. 2 using a filter selection unit. Red light, green light, and blue light pass through the filters R, G, and B respectively. The filter ND is a neutral filter suited for the human sight, and three color lights can all pass through the filter.

An image signal outputted from the image reading section 122 is processed by a signal processing section. A color signal for which a color is separated according to the toner color is outputted from the signal processing section, supplied to the laser writing system unit 100B which is an exposure means, and transferred to a recording paper as a toner image via the process which is the same as that for the printer in the first embodiment.

Also in the present embodiment, by installing the upper rollers of paper feed rollers 141, of fixing rollers 145A, and of paper discharge rollers 145B which constitute the feeding surface of the recording paper; the upper paper feed guide 142A; suction type conveyor belt 144; transfer pole 140; and separation pole 143 as well as the image reading system unit 100A on the upper frame 101 side, the recording paper feeding surface can be wholly opened as shown by an alternate long and short dash line when the cover of the upper frame 101 is removed, and the same effect as that of the printer in the first embodiment can be produced.

Instead of this configuration, an image reader using a color CCD or a color printer equipped with four developing units for Y, M, C, and BK can be used. In this case, it is desirable to arrange each two developing units symmetrically on the left and right in view of balance.

Next, embodiments of the present invention using a plurality of developing units which are arranged aside the image forming unit will be described.

FIG. 1(*b*) shows the fourth embodiment using a printer which the present invention is applied to.

The printer, in the same way as with the first to third embodiments, has a clamshell structure that it is divided into two parts, an upper frame 1 and a main unit 2 of the apparatus. The upper frame 1 can be retained at a predetermined angle by a hinge 1A attached to the main unit 2 or can be unitized with the main unit 2 by a fitting 1B when the frame is closed.

An image retainer 30 constituting an image forming section of the printer, developing units 36, 37, and 38 containing yellow, magenta, and cyan developers respectively, a cleaning unit 39, and a charger 35 are installed in a solid process cartridge 3, and the cartridge can be inserted into or removed from the main unit 2 via a pair of guide members 4 joined on the right and left outer surfaces of the cartridge.

The process cartridge 3 can be inserted and set in the depth direction of the main unit 2 using a handle (not shown in the figure) mounted to the front by the joints of the guide members 4 or can be removed from the main unit 2 by pulling out toward the operator since the guide members are released.

The printer uses a method that a laser writing system unit B is installed in the space aside the process cartridge 3; the feeding surface of a recording paper is over the portion across the upper frame 1 of the process cartridge 3 and the main unit 2; a laser beam is irradiated onto the image forming unit 30 by the laser writing system unit B from the lower point; and color toner images superposed on the peripheral surface of the image forming unit are transferred to the underside of the recording paper.

FIG. 3(*b*) shows the fifth embodiment using a copy machine which the present invention is applied to.

This embodiment, in the same way as with the fourth embodiment, has a clamshell structure that the apparatus is divided into two parts, an upper frame 101 and a main unit 102 of the apparatus. The upper frame 101 is supported with a hinge 101A so that it can be opened or closed; the upper frame 101 is also able to be fixed by a fitting 101B.

An image forming unit 130 constituting an image forming section of the copy machine, developing units 136, 137, and 138 containing yellow, magenta, and cyan developers respectively, a cleaning unit 139, and a charger 135 are installed in a process cartridge 103 which is the same type as that of the fourth embodiment, and the cartridge can be inserted into or removed from the main unit 102 via a pair of guide members 104 joined on the right and left outer surfaces of the cartridge according to the procedure for the process cartridge 3. The copy process is the same as that for the third embodiment.

In the fourth and fifth embodiments, the top of the process cartridge can be used as a part of the recording paper feeding surface. By doing this, the apparatus can be simplified in structure and configured so that the process cartridge can be pulled out upward from the main unit.

In the above embodiments, the cover of the upper frame is opened clockwise. However, by interchanging the hinge and fitting, the upper frame can be configured so that the cover of the upper frame can be opened counterclockwise.

Figure 4A:
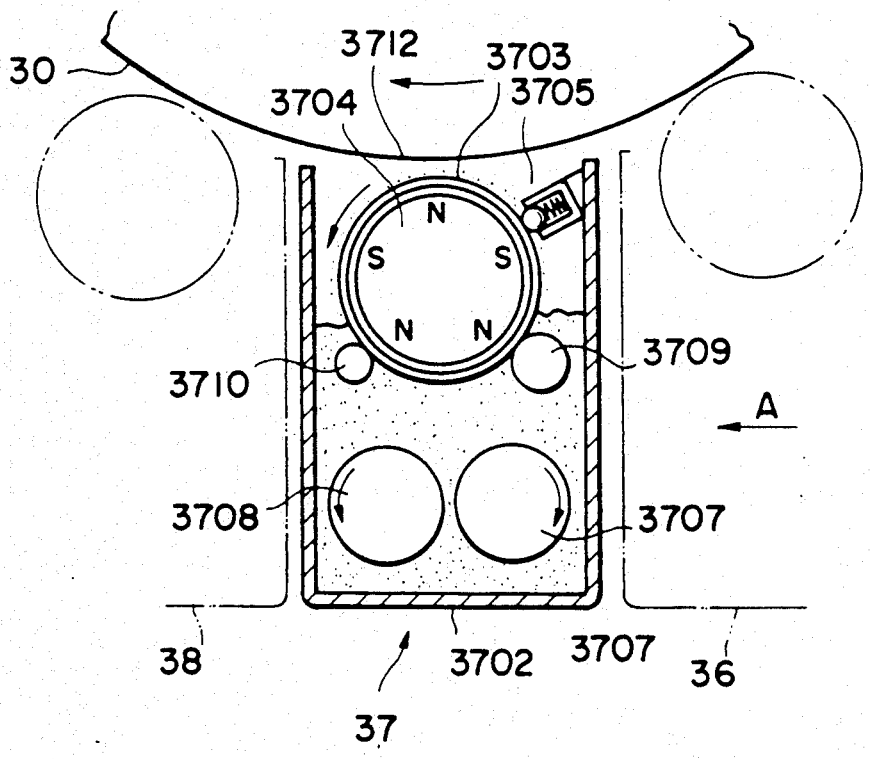
Figure 4B:
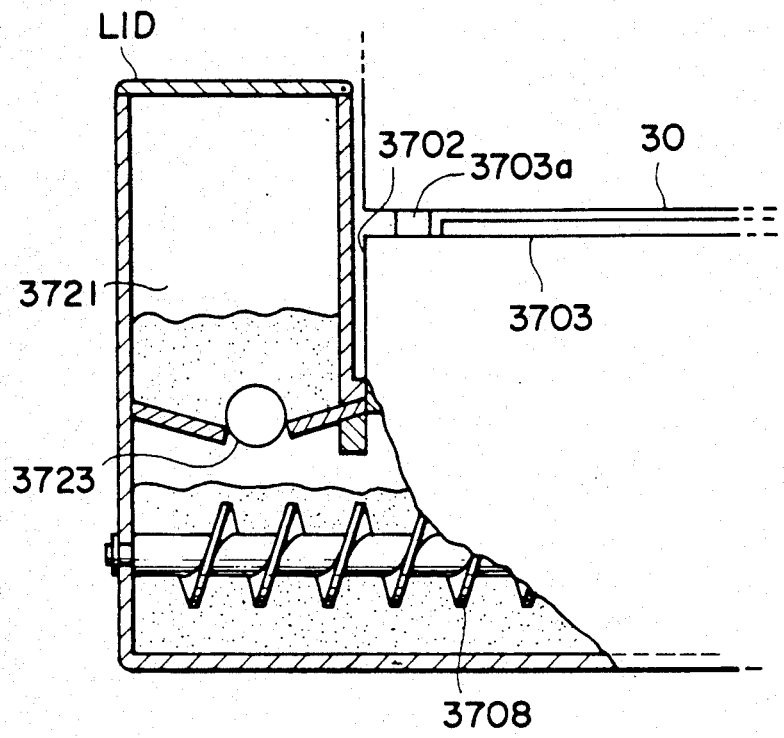
Figure 4C:
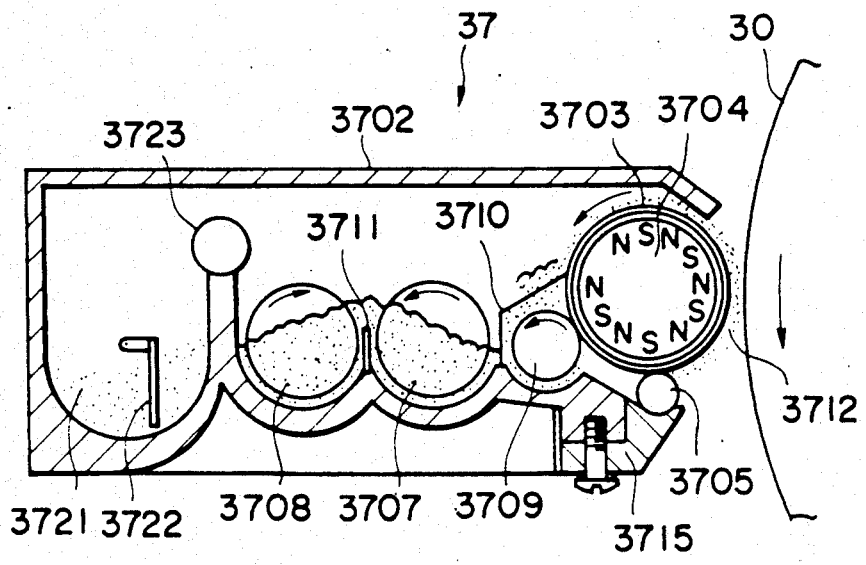
Figure 5A:
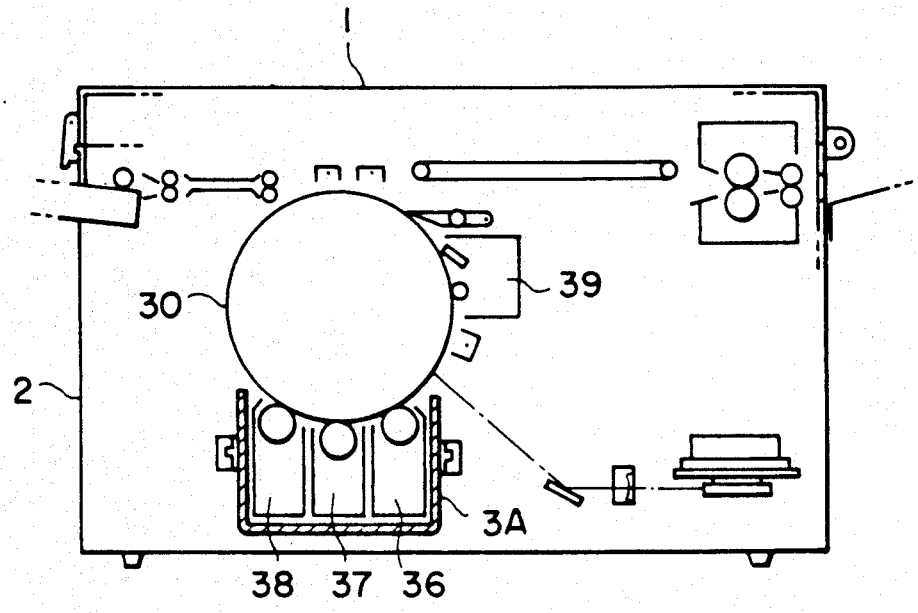
Figure 5B:
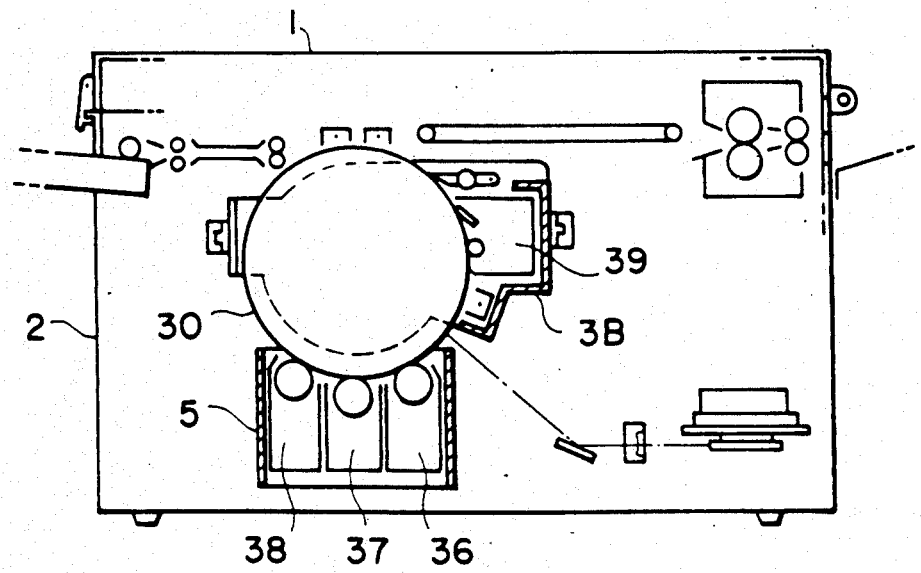
Figure 5C:
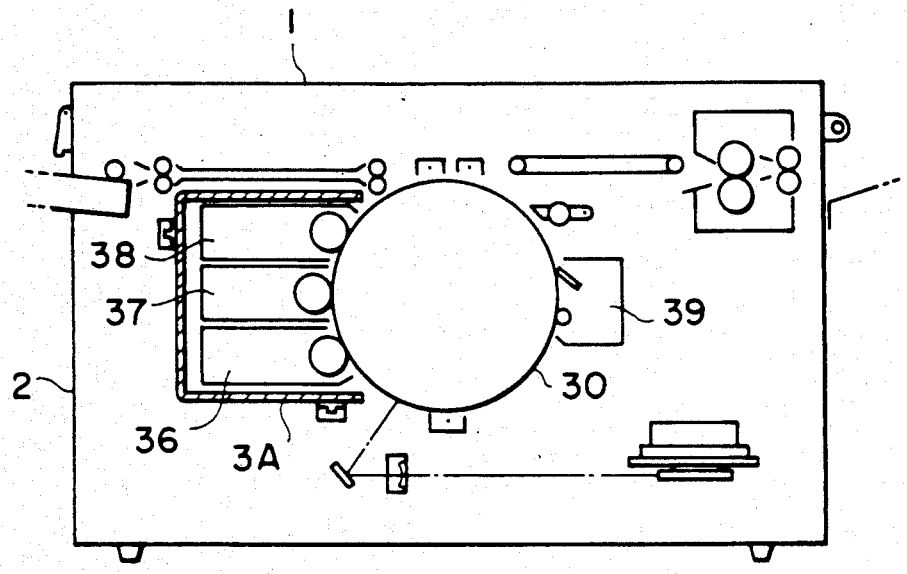
Figure 5D:
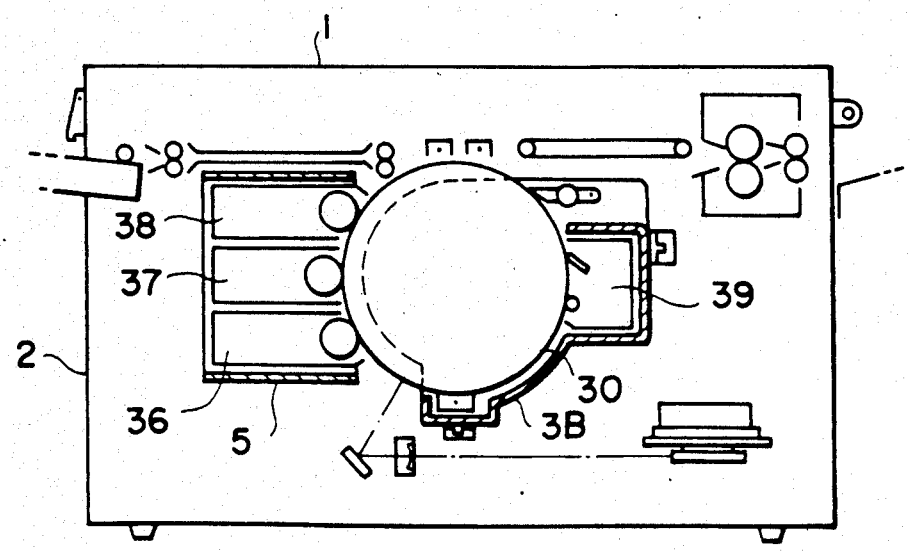

Each developing unit used in the above embodiments contains a specific color developer; and the structure and function of the developing unit in the first to third embodiments are the same as those of the developing unit of the printer shown in FIGS. 4(*a*) and 4(*b*): The structure and function of the developing unit in the fourth and fifth embodiments are the same as those of the developing unit shown in FIGS. 4(*c*).

In the figures, numeral 3702 designates a housing, 3703 a developing sleeve, 3704 a magnetic roller, 3705 a rigid and magnetic bar (a cylindrical bar) controlling the amount of a developer, 3715 a holder supporting the cylindrical bar 3705, 3706 a spring allowing a developer to be conveyed by the pressure of the cylindrical bar 3705 and of the developing sleeve 3703 (the cylindrical bar 3705 applies a constant load to the developing sleeve 3703 containing no developer), numerals 3707 and 3708 designate the 1st and 2nd stirrers, numeral 3709 designates a supply roller, 3710 a scraper, and 3711 a stirring diaphragm.

FIG. 4(*b*) is a partially sectional view of the view A shown in FIG. 4(*a*). In FIGS. 4(*b*) and 4(*c*), numeral 3721 designates a toner box incorporated in the housing 3702 and unitized with the developing unit, and 3723 a sponge roller conveying the toner contained in the toner box 3721 to the developing unit. The toner in the toner box 3721 is supplied to the developer stirring section by a rotating toner supply roller 3722 and the sponge roller 3723.

The toner supplied to the stirring section is fully stirred and mixed with a carrier by the first stirrer 3707 rotating in the direction of the arrow and by the 2nd stirrer 3708 rotating in the opposite direction overlappingly with the first stirrer; and then the toner and the carrier are supplied to the developing sleeve 3703 via the supply roller 3709 as a developer.

The 1st stirrer 3707 and the 2nd stirrer 3708 are spiral stirrers with a counterclockwise spiral angle which rotate in the directions of the arrows opposite to each other. The toner and the carrier conveyed deep by the thrust of the 2nd stirrer 3708 are further moved toward the 1st stirrer 3707 as shown in FIG. 4(*a*); and then the toner and the carrier are conveyed toward the front of the figure by the thrust of the 1st stirrer. In FIG. 4(*c*), the toner and carrier are moved toward the 1st stirrer 3707 passing over the stirring diaphragm 3711, the upper edge of which is inclined downward toward the depth of the figure, and then conveyed toward the front of the figure by the thrust of the 1st stirrer. By doing this, the toner and carrier are mixed to a homogeneous developer which is electrically charged by the friction caused by the mixing operation, and then adhered onto the peripheral surface of the developing sleeve 3703 as a layer by the sponge supply roller 3709 which rotates in the direction of the arrow.

In the above embodiments, this thin developer layer adhered to the fixed magnetic roller 3704 and to the peripheral surface of the developing sleeve 3703 which rotates in the direction of the arrow (clockwise) develops latent images provided on the image forming unit 30 which rotates in the direction of the arrow in a developing area 3712 by a non-contact development providing an interval between the developing sleeve and the toner images on the image forming unit.

During this non-contact development, a developing bias current including an AC component is supplied to the developing sleeve 3703 from a power source not shown in the figure. As a result, only the toner contained in the developer on the developing sleeve 3703 is selectively transferred and adhered to the latent image surface.

The developer which consumes the toner component increases in carrier ratio, is conveyed by the developing sleeve 3703, scraped off and collected by the scraper 3710, and mixed with a developer with a high toner ratio.

To make the process cartridge used in the above embodiments small and light in weight so as to facilitate the insertion and removal operation for the main unit of the apparatus, the process cartridge may contain only a group of the developing units or a group of the image forming unit and the cleaning unit.

FIG. 5 shows examples of the printer. FIGS. 5(*a*) and 5(*c*) show examples in which an image retainer 30 and a cleaning unit 39 are mounted directly and independently to a main unit 2 of the apparatus and a process cartridge 3A contains only developing units 36, 37, and 38. FIGS. 5(*b*) and 5(*d*) show examples in which the developing units 36, 37, and 38 are directly stored in a developing unit garage 5 mounted to the main unit 2 and only the image retainer 30 and the cleaning unit 39 are contained in the process cartridge 3B.

A developing unit containing a black toner may be additionally used.

The present invention provides a color image forming apparatus which prevents an exposure optical system or a recording paper from being soiled by toners so as to form high quality images and configures the recording paper feeding surface horizontal and flat so as to facilitate jamming repair or maintenance.

Furthermore in the color image forming apparatus of the present invention, even if the apparatus has a clamshell structure that the paper feeding surface can be opened because process units such as the image forming unit, developing units, and cleaning unit are unitized and the unitized group is located under the feeding surface, there is no need to move the process unit and the apparatus can be easily operated and stably balanced.

What is claimed is:

1. An electrostatic image forming apparatus for forming a color image comprising;

an image retainer for carrying said color image, a charging means for charging a surface of said image retainer, a means for forming a latent image on the charged surface of said image retainer, a plurality of developing means for developing said latent image, wherein said developing means are positioned adjacent each other under said image retainer, a transfer sheet conveyance means for conveying a transfer sheet to a transfer means, said transfer means for transferring said developed latent image onto said transfer sheet, wherein said transfer sheet conveyance means and said transfer means are movably located on the upper side of said image retainer, a top frame part of said electrostatic image forming apparatus, comprising said transfer sheet conveyance means and said transfer means, being adapted to be opened, and a cleaning means for cleaning residual toner from the surface of said image retainer, wherein said image retainer, said cleaning means, and said developing means, are formed as a unit and said unit is detachable from said electrostatic image forming apparatus.

2. The apparatus of claim 1 wherein said top frame part further comprises a scanning means.

3. An electrostatic image forming apparatus for forming a color image comprising;

an image retainer for carrying said color image, a charging means for charging a surface of said image retainer, a means for forming a latent image on the charged surface of said image retainer, wherein said latent image forming means forms said latent image under said image retainer, a plurality of developing means for developing said latent image to form a toner image, wherein said developing means are positioned adjacent to each other on a side of said image retainer, a transfer sheet conveyance means for conveying a transfer sheet to a transfer means, said transfer means for transferring said toner image onto said transfer sheet, wherein said transfer sheet conveyance means and said transfer means are movably located on the upper side of said image retainer, a top frame part of said electrostatic image forming apparatus, comprising said transfer sheet conveyance means and said transfer means, being adapted to be opened, and a cleaning means for cleaning residual toner from the surface of said image retainer, wherein said image retainer, said cleaning means and said developing means, are formed as a unit and said unit is detachable from said electrostatic image forming apparatus.

4. The apparatus of claim 3 wherein said top frame part further comprises a scanning means.

5. An electrostatic image forming apparatus for forming a color image comprising;

an image retainer for carrying a color image, a charging means for charging a surface of said image retainer, a means for forming a latent image on the charged surface of said image retainer, a plurality of developing means for developing said latent image to produce a toner image, said developing means being positioned adjacent to each other under said image retainer, a transfer sheet conveyance means for conveying a transfer sheet to a transfer means, said transfer means for transferring said toner image onto said transfer sheet, wherein said transfer sheet conveyance means and said transfer means are movably located on the upper side of said image retainer, a top frame part of said electrostatic image forming apparatus, comprising said transfer sheet conveyance means and said transfer means, being adapted to be opened, and a cleaning means for cleaning residual toner from the surface of said image retainer, wherein said image retainer, and said cleaning means are formed as a first unit and said plurality of developing means are formed as a second unit, said first unit and said second unit being individually detachable from said electrostatic image forming apparatus.

6. An electrostatic image forming apparatus for forming a color image comprising;

an image retainer for carrying a color image, a charging means for charging a surface of said image retainer, a means for forming a latent image on the charged surface of said image retainer, wherein said latent image forming means forms said latent image under said image retainer, a plurality of developing means for developing said latent image to produce a toner image, said developing means being positioned adjacent to each other on the side of said image retainer, a transfer sheet conveyance means for conveying a transfer sheet to a transfer means, said transfer means for transferring said toner image onto said transfer sheet, wherein said transfer sheet conveyance means and said transfer means are movably located on the upper side of said image retainer, a top frame part of said electrostatic image forming apparatus, comprising said transfer sheet conveyance means and said transfer means, being adapted to be opened, and a cleaning means for cleaning residual toner from the surface of said image retainer, wherein said image retainer, and said cleaning means are formed as a first unit and said plurality of developing means are formed as a second unit, said first unit and said second unit being individually detachable from said electrostatic image forming apparatus.

7. The apparatus of claim 6 wherein said top frame part further comprises a scanning means.

* * * * *